United States Patent [19]

Keller

[11] 3,985,073

[45] Oct. 12, 1976

[54] NUMBERING HEAD ATTACHMENT FOR A PRINTING PRESS

[76] Inventor: James J. Keller, 204 S. 6th, Mount Horeb, Wis. 53572

[22] Filed: June 30, 1975

[21] Appl. No.: 591,290

[52] U.S. Cl. ..... 101/76; 101/247

[51] Int. Cl.[2] ..... B41L 49/02

[58] Field of Search ..... 101/70, 72, 76, 77, 101/218, 247, 145, 144

[56] References Cited

UNITED STATES PATENTS

| | | | |
|---|---|---|---|
| 1,920,232 | 8/1933 | Allen | 101/77 |
| 2,398,832 | 4/1946 | Jirousek | 101/77 |
| 2,683,409 | 7/1954 | Dutro et al. | 101/77 |
| 2,900,898 | 8/1959 | Buttner | 101/76 |
| 3,048,099 | 8/1962 | Davidson et al. | 101/72 X |
| 3,782,277 | 1/1974 | Neal | 101/76 |

*Primary Examiner*—E. M. Coven
*Attorney, Agent, or Firm*—James E. Nilles

[57] ABSTRACT

A numbering head assembly for use with a printing press and for printing consecutive numbers on material printed in the press such as invoices, tickets, etc. The numbering head assembly includes a rotating numbering head for printing consecutive numbers on each piece of paper passed through the printing press and means for supporting the rotatable numbering head in a position where it may be forced into printing engagement with the impression cylinder of the printing press. The assembly also provides means to index the numbering head once for each piece of paper printed so that a consecutive number is printed on each paper and means to selectively actuate the numbering head so that the head is brought into printing engagement with the impression cylinder only when paper is passed through the printing press.

7 Claims, 12 Drawing Figures

NUMBERING HEAD ATTACHMENT FOR A PRINTING PRESS

BACKGROUND OF THE INVENTION

The present invention relates to a numbering head assembly which can be attached to a printing press to enable the printing of consecutive numbers on each sheet of paper printed in the printing press. More particularly, the invention is directed to a relatively inexpensive and uncomplicated numbering head assembly which may be attached to an offset press to facilitate use of the press to print consecutive numbers.

The prior art illustrates that it is known to provide means for printing consecutive numbers on printed items such as invoices or tickets. However, such printing presses which are generally used are relatively large and, consequently, expensive. Smaller, less expensive printing presses have not been provided with means which facilitate consecutive numbering of material printed therein. Consequently, operators of larger, more expensive printing presses have had a competitive advantage over their not so affluent competitors because it was generally necessary for operators of smaller printing presses to use a separate numbering machine to print consecutive numbers. This required that printed material be run in two consecutive operations requiring generally twice the time required with the larger, more expensive printing presses which allowed both operations to be performed simultaneously.

Previous attempts have been proposed to adapt smaller printing presses to include consecutive numbering means to facilitate simultaneous printing and consecutive numbering of printed material. However, the apparatus which has been proposed is either unduly complicated and costly to attach to the printing presses to the extent that such apparatus is prohibitively expensive, or the apparatus previously proposed was incapable of producing a quality impression on the printed matter. One such known attachment provides means which are secured to the printing press in such a manner that printed sheets could be consecutively numbered prior to removal from the feeder unit. Such apparatus have the drawback, however, that the printed paper receives the printing head when the paper is stacked in relatively soft piles and, consequently, the impressions printed thereon were often smudged or otherwise undesirable.

SUMMARY OF THE INVENTION

The present invention provides a numbering head assembly which can be attached to a printing press to facilitate simultaneous consecutive numbering of printed matter and which avoids each of the drawbacks of the prior art proposals.

The consecutive numbering assembly of the present invention includes a rotating numbering head which can be attached to an offset printing press in such a manner that the numbering head can be selectively actuated to engage the impression cylinder of the press under pressure to print numbers on paper passed through the offset press. The assembly includes means to selectively cause the numbering head to be brought into printing engagement with the impression cylinder only when the printing press is actually printing and further includes means to selectively index the numbering head after each printing cycle.

Since the numbering head assembly is connected to the printing press such that the numbering head can be brought into printing engagement with the impression cylinder under pressure, the assembly permits the printing of clear, precise impressions. The assembly of the present invention is also particularly uncomplicated so that it is not expensive to attach to the printing press or require costly maintenance. The assembly is also designed to be operably connected to the drive means of the printing press so that additional drive means are not required.

DESCRIPTION OF THE PREFERRED EMBODIMENT

Figure 1:
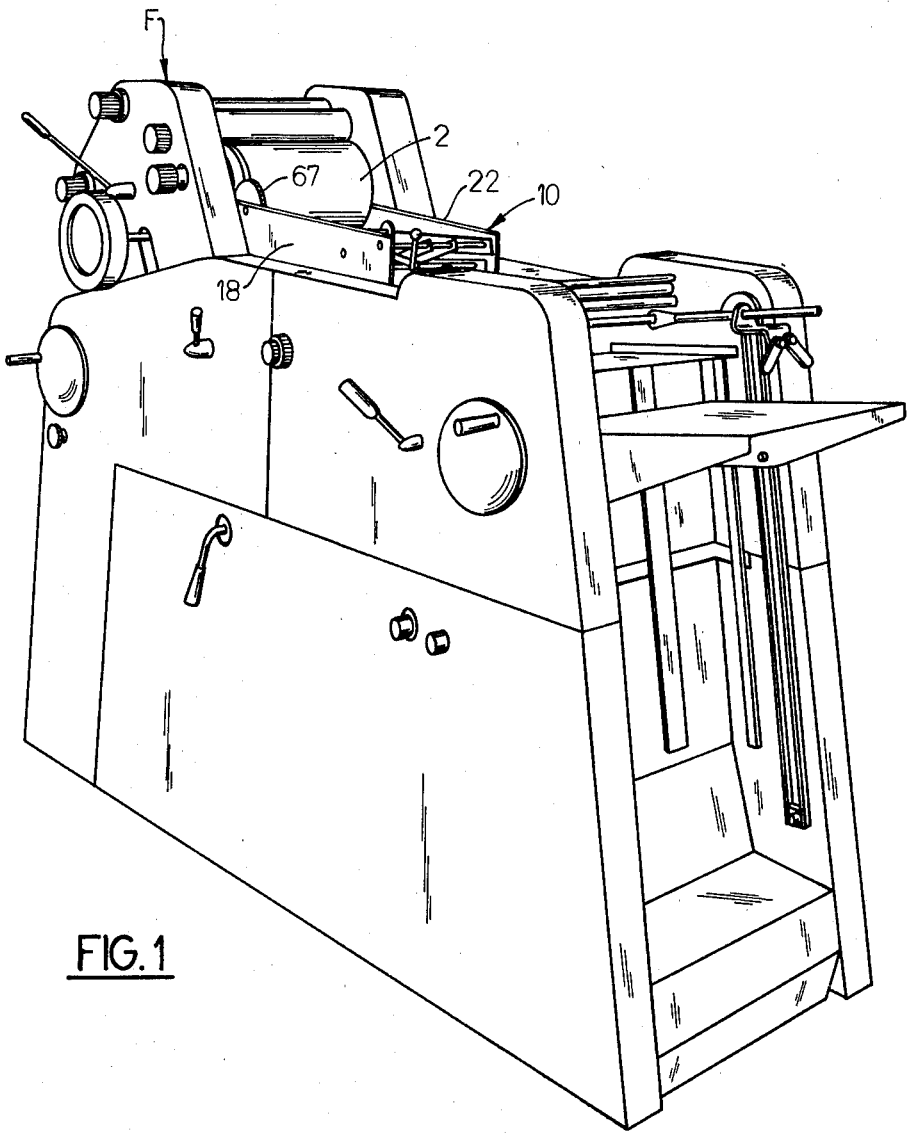
FIG. 1 is a perspective view of a printing press including the numbering head assembly of the present invention.
Figure 2:
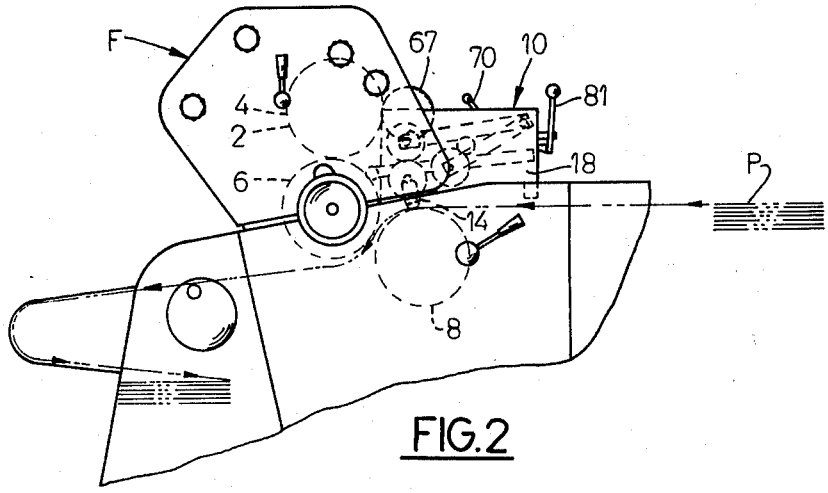
FIG. 2 is a partial side view of the printing press shown in FIG. 1 with the numbering head assembly of the invention attached thereto.

FIG. 1 shows the numbering head assembly 10 of the present invention attached to and operative with an offset printing press. The numbering head assembly of the present invention is particularly adapted to be used with "Chief 15" offset printing presses produced by White Consolidated Industries of Whitinsville, Mass. The structure and mode of operation of such presses is well known and is not within the bounds of the invention. Therefore, only the structure of the press which is necessary for the purpose of illustration of the invention is shown in the drawings. As shown in FIG. 2, an offset press such as the "Chief 15" generally includes a plate cylinder 2, driven by plate cylinder gear 4, and a blanket cylinder 6 rotatable with the plate cylinder 2. Such presses also include an impression cylinder 8 which is capable of supporting paper P fed thereto and which is received between the cylinders 6 and 8 in such a manner that it can be printed. The respective cylinders 2, 6 and 8 are each supported by the frame structure F of the printing press. As particularly shown in FIGS. 9 and 10, the blanket cylinder 6 is selectively actuatable to be moved in a direction transverse to its axis such that it can be forced into surface contact with the plate cylinder 2 and with the impression cylinder 8 during a printing step.

The numbering head assembly 10 of the present invention is shown in greater detail in FIGS. 3–12 and as generally including a numbering head 14 which is rotatable with a shaft 16. The shaft 16 is supported in a manner to be described hereafter and in such a position that the numbering head 14 can be selectively forced against the impression cylinder 8 (FIG. 7) to print consecutive numbers on consecutive pieces of paper received in the printing press and while the pieces of paper are held between the blanket cylinder and the impression cylinder in printing engagement. The numbering head 14 is of the type which is well known and which includes numbered type 12 arranged on printing wheels 13 which can be indexed by activation of lever 15 so as to print consecutive numbers. The numbering head 14 includes a collar 11 which receives shaft 16 and which can be secured to the shaft 16 by set screw 17.

The present invention is particularly directed to an assembly for supporting the rotatable numbering head 14 with respect to the various cylinders 2, 6 and 8 of the printing press in a manner which permits the numbering head to print under pressure against the impression cylinder 8 to form a clear printed impression and in such a manner that the number printed by the numbering head 14 is indexed after each successive printing.

Figure 9:
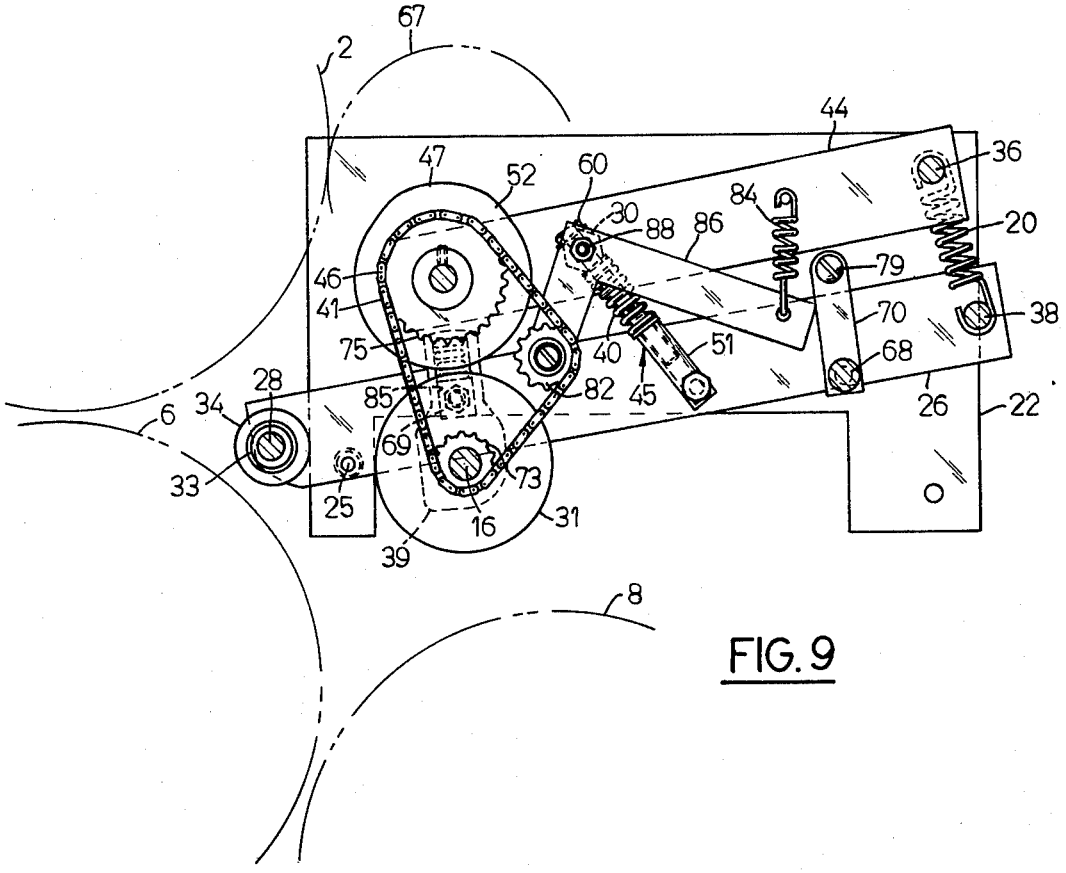
FIGS. 9–11 are cross-sectional views generally taken along line 9—9 in FIG. 4 but showing the positions of the numbering head in response to movement of the blanket cylinder.

In offset printing presses, such as the "Chief 15" illustrated, the printing press includes means to actuate the blanket cylinder 6 such that it is forced toward the plate cylinder 2 and the impression cylinder 8 into printing engagement therewith when a piece of paper is fed through the press and received on the impression cylinder for printing. It has been found that during the operation of the press, it may be desirable to interrupt the feeding of paper to the printing press but to allow the respective cylinders to continue to rotate. In such cases the blanket cylinder 6 is disengaged or moved away from the plate cylinder 2 and the impression cylinder 8 (FIG. 9). The numbering head assembly 10 of the present invention is specifically provided with means to take advantage of this selective actuation of the blanket cylinder 6 to permit simultaneous engagement of the numbering head 14 and the blanket cylinder 6 with the impression cylinder 8 and to index the numbering head 14 to print a successive number when each piece of paper is received through the printing press but to avoid indexing of the numbering head when printing is not actually being performed.

Figure 3:
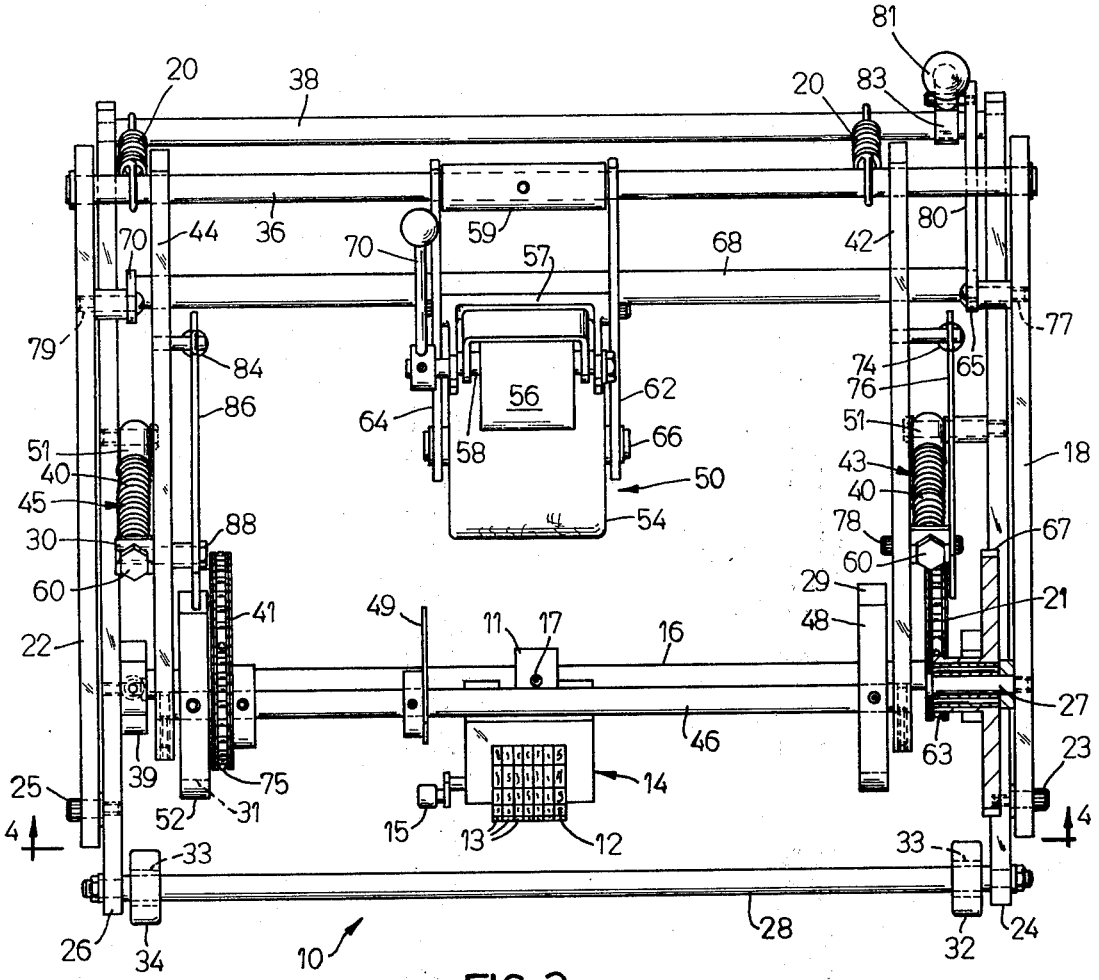
FIG. 3 is a top plan view of the numbering head assembly of the invention.

The numbering head assembly 10 includes a pair of rigid side plates 18 and 22 which are provided to support each of the various moving parts of the numbering head assembly 10 and which can be secured by bolts (not shown) extending through pre-existing holes in the frame structure of the printing press. Referring to FIG. 3, a pair of pivotable arms 24 and 26 are each pivotably connected at a point near one of their ends to the side plates 18 and 22 by bolts 23 and 25 and are connected together at that end by a shaft 28. A pair of spaced rollers 32 and 34 are supported by bearings 33 on opposite ends of the shaft 28 and ride on the surface of the blanket cylinder 6 at each of its ends. The spaced rollers 32 and 34 are supported on the surface of the blanket cylinder 6 in such a manner that movement of the blanket cylinder 6 into and out of engagement with the plate cylinder 2 and impression cylinder 8 will cause pivotal and simultaneous movement of both of the pivotable arms 24 and 26. It should be noted that the pivotable arms 24 and 26 are connected to the side walls 18 and 22, respectively, at a position on the pivotable arms which is relatively close to the ends supporting the shaft 28. Consequently, as shown by comparison of FIGS. 9 and 10, slight movement of the blanket cylinder 6 and the ends of the pivotable arms 24 and 26 supporting shaft 28 will result in substantial movement on the opposite ends of the arms. The arms 24 and 26 are generally biased into engagement with the cylinder 6 by a pair of springs 20 which are each secured at one end to a shaft 38 which connects the ends of the arms and secured at the other end to a rigid support shaft 36.

Figure 10:
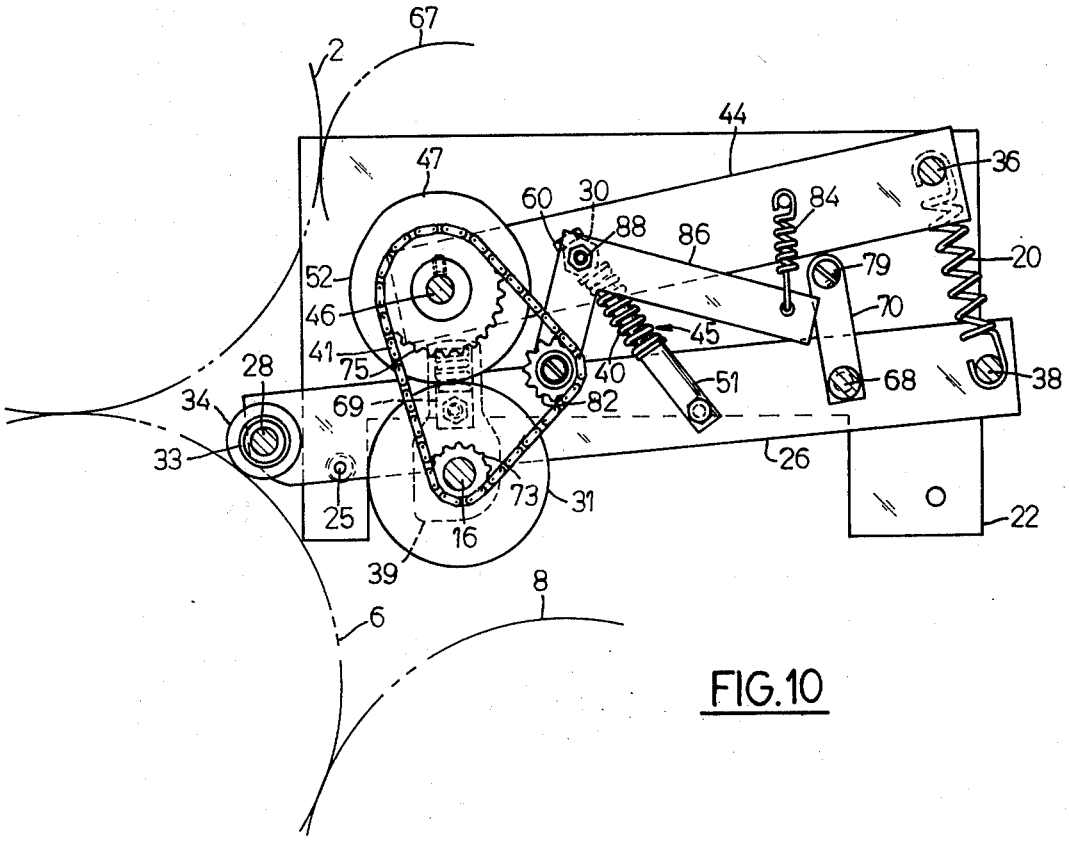
Figure 11:
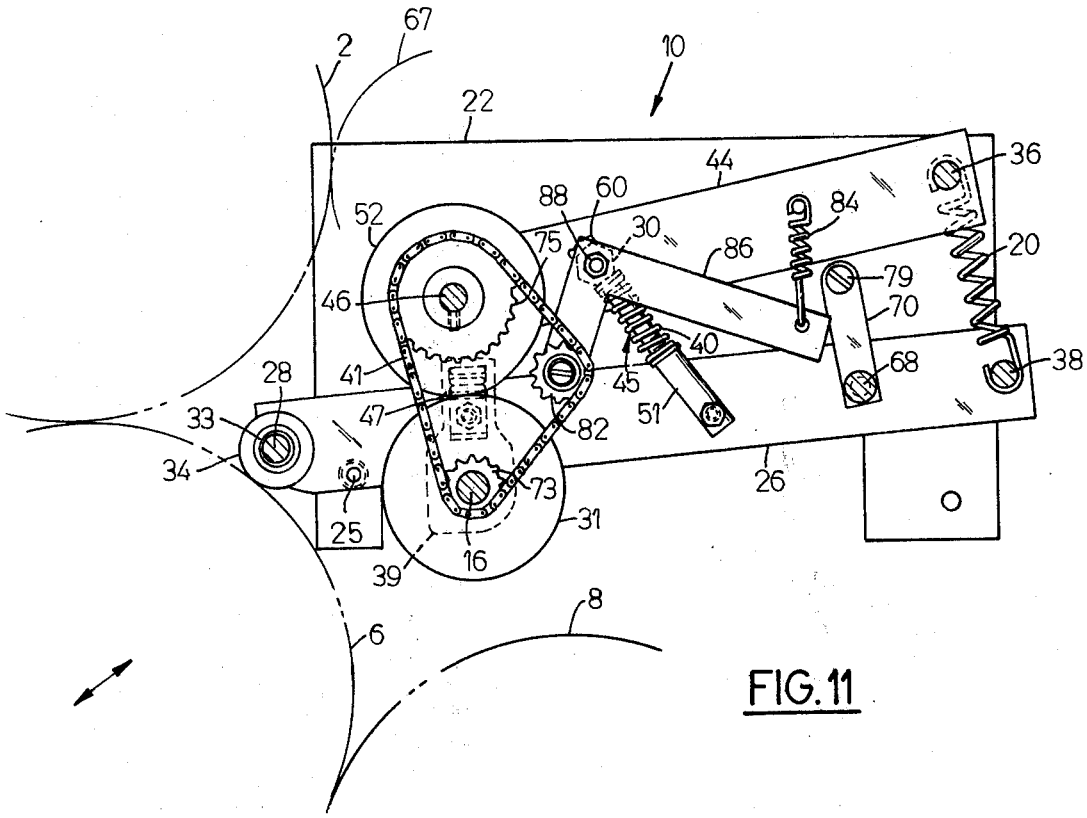

The rigid support shaft 36 functions to support the side walls 18 and 22 in spaced relation as best shown in FIGS. 9–11, and to support a pair of cam supporting arms 42 and 44 pivotably attached to it and extending toward the blanket cylinder 6. The ends of the cam supporting arms 42 and 44 opposite those ends pivotably received on the support shaft 36 rotatably support opposite ends of a cam shaft 46. The cam shaft 46, in turn, supports a pair of spaced cams 48 and 52 generally mounted at each of its ends. The pivotable cam supporting arms 42 and 44 are connected to the pivotable arms 24 and 26, respectively, by threaded tie rods 43 and 45. Each of the tie rods 43 and 45 is threadably received at one end in collars 51 attached to the arms 24 and 26 and slideably received in a collar 30 secured to each of the arms 42 and 44 by bolts 78 and 88, respectively. The tie rods 43 and 45 each include a head 60 which abuts the collar 30 to create a downward torque on the respective cam supporting arms to which it is attached in response to downward pivotal movement of the pivotable arms 24 and 26. Each of the tie rods 43 and 45 is surrounded by a spring 40 extending between the collars 30 and the collars 51 of the cam supporting arms 42 and 44 in such a manner as to bias the cam supporting arms 42 and 44 upwardly.

As best shown in FIGS. 4 and 9–12 the shaft 16 is supported from the arms 24 and 26 by a pair of slideable mounting members 37 and 39. The slideable mounting members 37 and 39 include bearings 53 and 55 for receiving opposite ends of the shaft to permit rotation of the shaft. The slideable mounting members 37 and 39 also each include a vertically extending track 85 receiving a rectangular slideable bearing 69 and a spring 61. The slideable bearings 69 are secured to the arms 24 and 26 respectively by bolts 71 but are movable with respect to the mounting members in the vertically extending track 85. The members 37 and 39 are thus vertically slideable with respect to the slideable bearings 69 and arms 24 and 26 but rigidly restrained from other motion. The springs 61 generally function to bias the mounting members 37 and 39 and the numbering head shaft 16 vertically upward and spaced from the impression cylinder 8, but a downward force on the shaft 16 causes the mounting members to slide downwardly relative to the slideable bearings 69 and against the biasing force of the springs 61 such that numbering head 14 can be brought into printing engagement with the impression cylinder.

Figure 4:
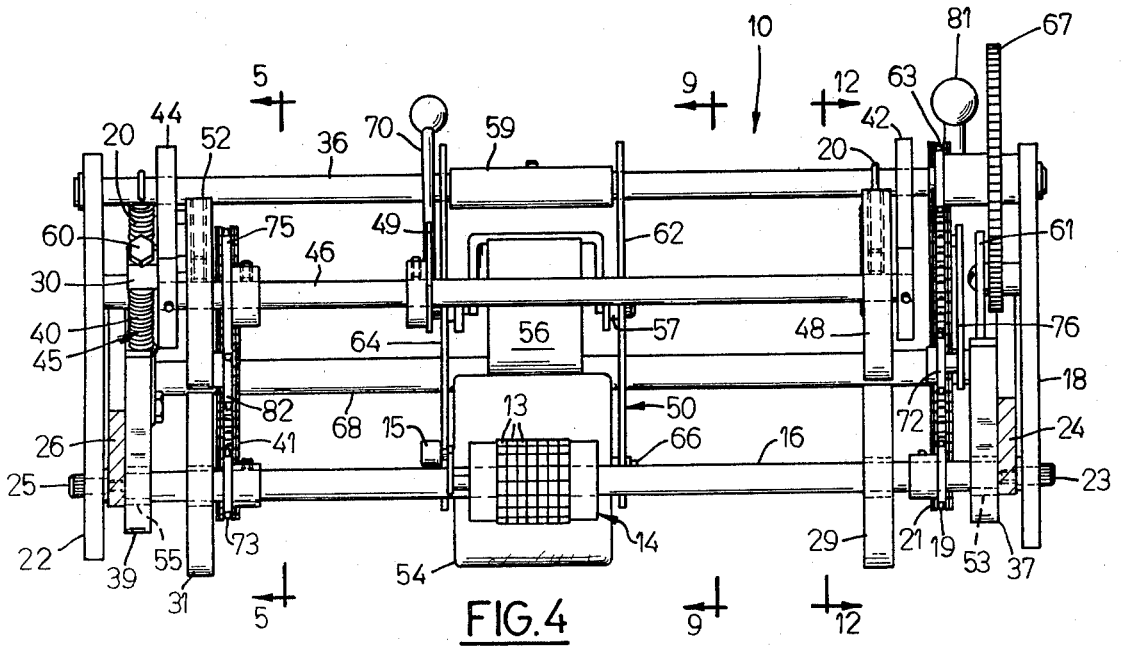
FIG. 4 is a cross sectional view along line 4—4 in FIG. 3.
Figure 12:
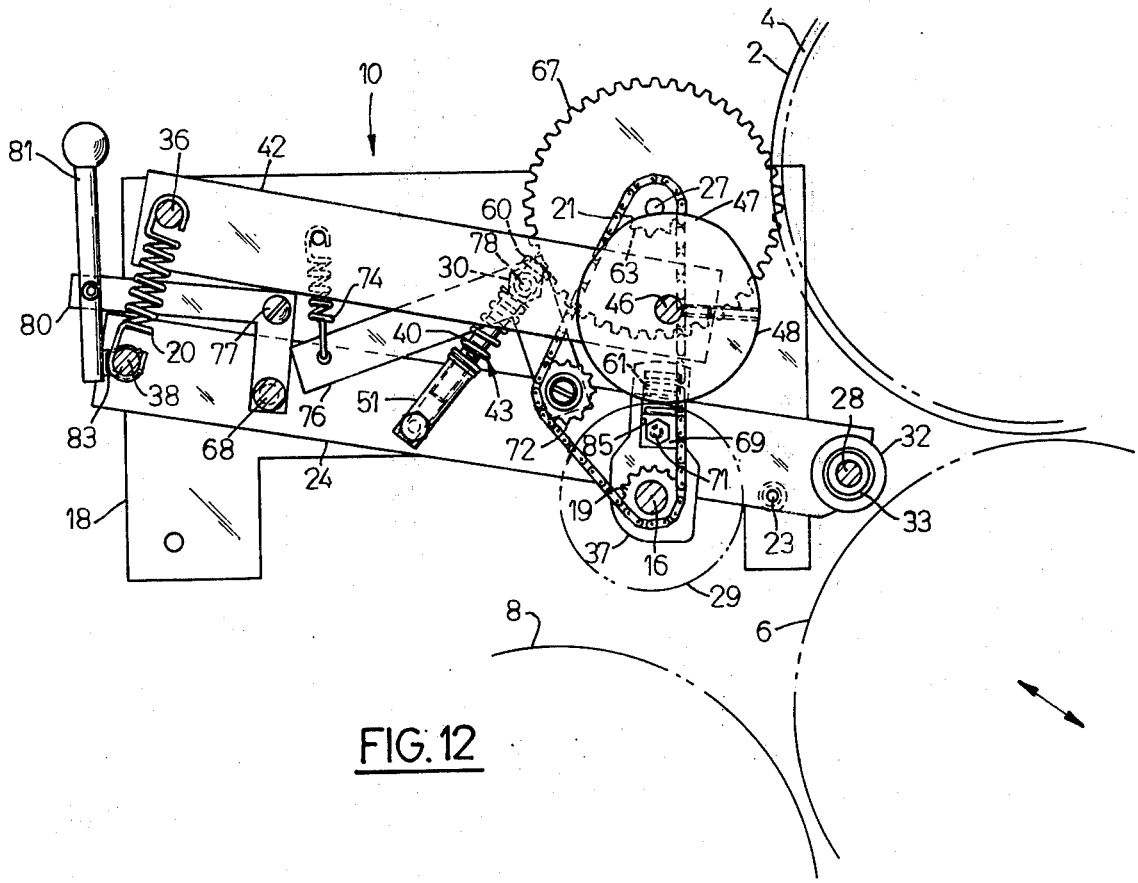
FIG. 12 is a cross-sectional view taken along line 12—12 in FIG. 4.

As stated, the numbering head 14 is secured to a collar 11 which is, in turn, rigidly secured to the numbering head shaft 16 in such a manner that it rotates with the shaft. The collar 11 is releasably secured to the shaft 16 by a set screw 17 however, such that the axial and rotational position of the numbering head 14 with respect to the shaft 16 can be adjusted. Such adjustment of the numbering head facilitates printing a number substantially anywhere on a paper P. As shown in FIGS. 4 and 12, the numbering head shaft 16 also includes a drive sprocket 19 which receives a chain 21. The chain 21 is operably connected by a sprocket 63 to a drive gear 67. The drive gear 67 and the sprocket 63 are secured together and adapted to rotate about a shaft 27 which is rigidly secured to the side wall 18. The drive gear 67 is positioned in meshing engagement with the plate cylinder gear 4 such that rotation of the plate cylinder 2 and the plate cylinder gear 4 results in rotation of the drive gear 67 and consequent rotation of the numbering head shaft 16.

Referring to FIG. 4, the numbering head shaft 16 also rotationally supports a pair of spaced circular idler discs 29 and 31 arranged below and in alignment with the spaced cams 48 and 52 such that the peripheral edges of the cams 48 and 52 will be received on the peripheral edges of the idler discs 29 and 31. The idler discs are mounted on bearings so as to be independently rotatable relative to the numbering head drive shaft 16. The numbering head shaft 16 further includes a sprocket 73 secured to the end of the shaft opposite that receiving sprocket 19. The sprocket 73 receives a chain 41 which, in turn, drives a sprocket 75 secured to the cam shaft 46. The numbering head shaft 16 and the cam shaft 46 can thus be driven by the plate cylinder gear 4 and at a fixed relative rotation with respect to each other. The fixed relative rotation of the shafts permits a timed engagement of the cams 48 and 52 to activate the numbering head 14 into printing engagement as will be described.

As previously stated, the cam drive shaft 46 and the numbering head drive shaft 16 are relatively vertically movable. Therefore, the chains 21 and 41 are each provided with a spring biased idler sprocket 72 and 82 to absorb slack in the chains 21 and 41 when the drive shafts are moved relative to each other and to permit the chains to remain taut and in driving engagement. Referring to FIGS. 3–4 and 12, the chain 21 is provided with idler sprocket 72 which is mounted on a bracket 76 and spring biased by a spring 74 into engagement with the chain 21. The bracket 76 is pivotably mounted on the shaft 78 extending through the arm 42 and supporting the collar 30. The take-up sprocket 82 shown in FIGS. 9 and 10 is similarly mounted by a bracket 86 and biased by a spring 84. The bracket 86 is pivotably mounted on the shaft 88 extending through arm 44 and supporting the collar 30. As an alternative to the sprocket and chain drive mechanism recited, it would be equally feasible to provide a combination of belts and pulleys in similar arrangement as the driving means.

In order that the numbering head 14 indexed after each printing engagement the numbering head includes an indexing lever 15, shown in FIGS. 3–8. An indexing cam lobe 49 is secured to the cam shaft 46 for rotation therewith and positioned thereon is such a manner as to contact the lever 15 (FIG. 8) during relative rotation of the shafts 16 and 46, to selectively actuate the indexing lever 15 in a manner to be described here-after. The indexing cam lobe 49 is secured to the shaft 46 by a set screw so that it may be axially or rotatably adjusted so that it can be properly aligned with the numbering head 14 and the indexing lever 15.

Figure 5:
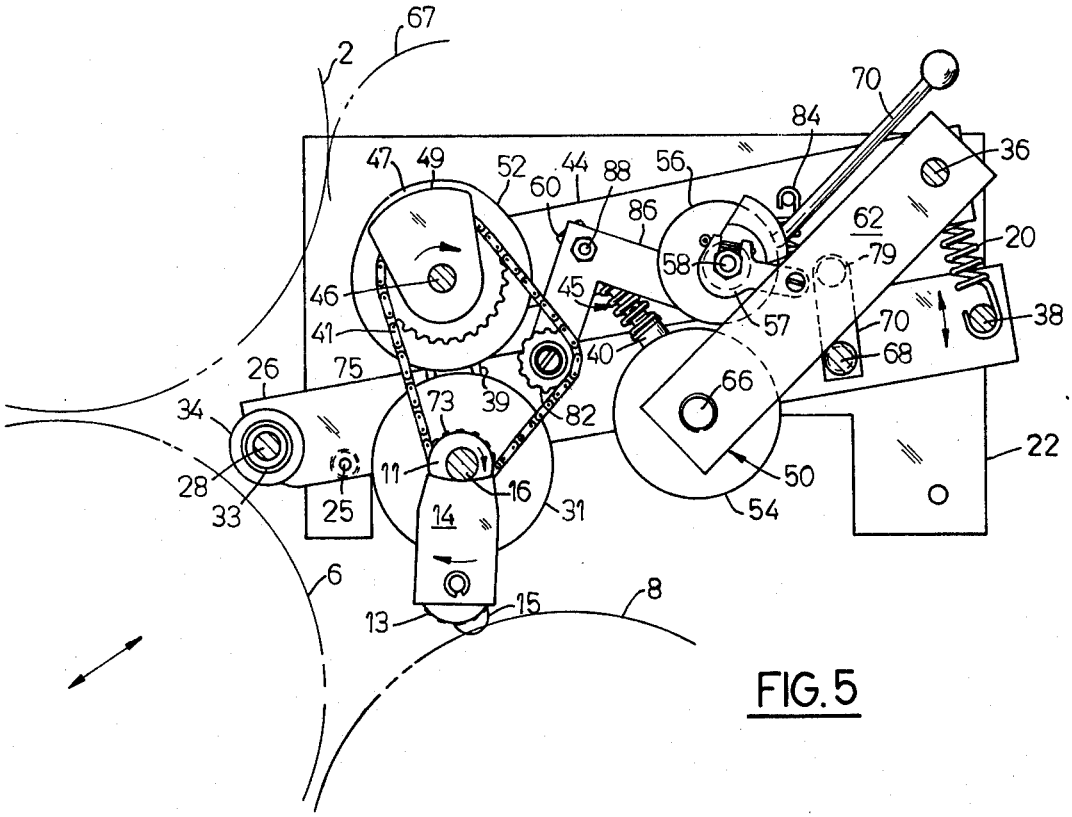
FIGS. 5–8 are cross-sectional views generally along line 5—5 in FIG. 4 but showing the numbering head and cams in successive positions of rotation about their respective shafts.
Figure 6:
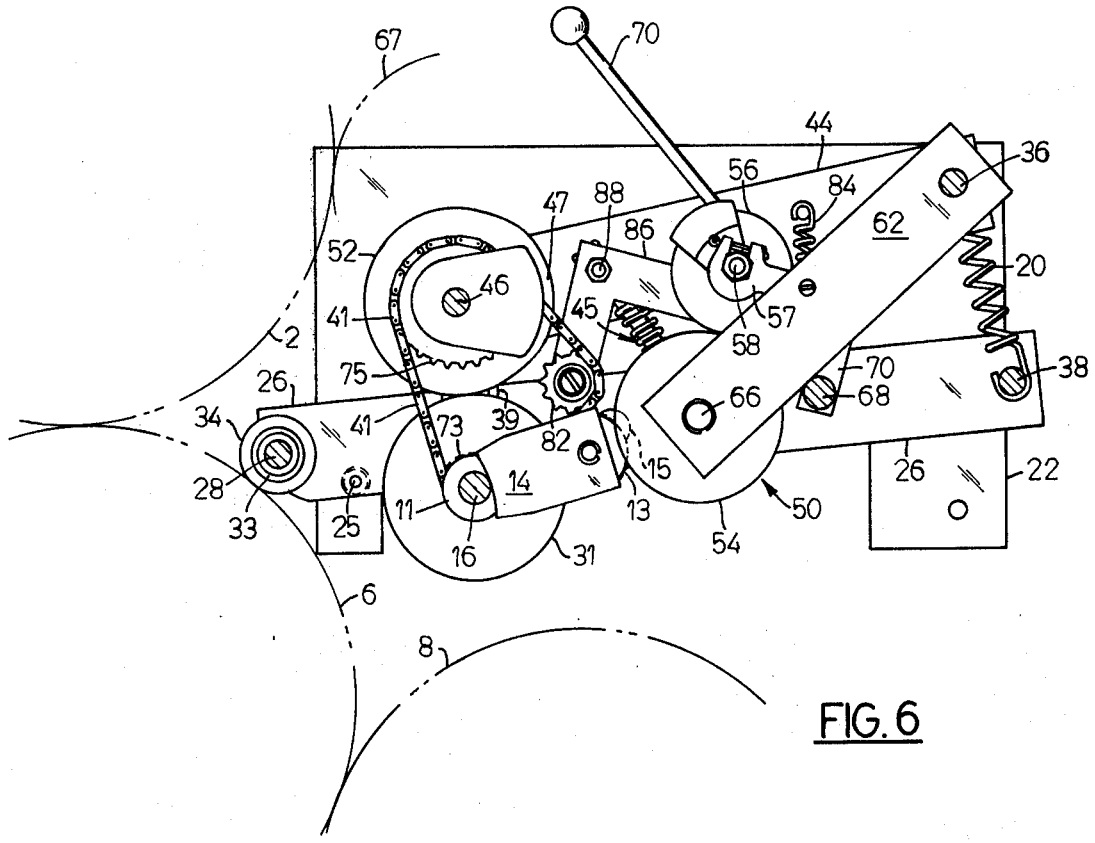

As best shown in FIGS. 5 and 6, the support shaft 36 which supports the cam arms 42 and 44 also supports an inking assembly 50 which is operable to controllably supply ink to the numbering head 14. The inking assembly generally includes an inking roller 54 comprised of an absorbent material which is capable of transmitting ink to the numbering head 14 when the head rotates into surface contact with the inking roller 54 as shown in FIG. 6. The inking roller 54 is suspended from the shaft 36 by a pair of arms 62 and 64. The arms 62 and 64 supporting the inking roller 54 are held in position on the shaft 36 by a collar 59 which is secured to the shaft by a set screw. The inking assembly 50 also includes an ink supply drum 56 which is rotatably mounted on an eccentric shaft 58 above the inking roller 54. The eccentric shaft 58 is supported at each of its ends by a bracket 57 which is rigidly secured between the arms 62 and 64. The shaft 58 can be rotated to bring the inking drum into engagement with the inking idler 54 as shown in FIG. 6 by operation of lever 70 rigidly connected to the end of the shaft. A shaft 68 extending between the side plates 18 and 22 is provided to force the inking roller 54 to swing in an arc such that it can contact the rotating numbering head 14. The eccentric shaft is suspended by a pair of generally vertically extending levers 65 and 70 rotatably mounted on bolts 77 and 79 extending through the side plates 18 and 22. The lever 65 includes a horizontally and rearwardly extending projection 80. Downward force on the projection 80 causes rotation of the levers 65 and 70 around bolts 77 and 79 and forces shaft 68 to swing the inking roller 54 into engagement with the numbering head. A lever 81 is attached to the projection 80 and includes a spring clip 83 fixed to its lower end. The spring clip 83 may be received around the shaft 38 to hold projection 80 in a downward position and consequently hold the inking roller 54 in position to supply ink to the numbering head.

OPERATION

During the operation of the numbering head assembly 10 of the present invention in an offset printing press, paper P is fed into the press activating the blanket cylinder 6 which moves into printing engagement with the plate cylinder 2 and the impression cylinder 8. Such movement of the blanket cylinder 6 applies an upward force to the shaft 28 and a consequent pivotal movement of the pivotal arms 24 and 26. Such pivotal movement causes the numbering head shaft 16 to pivot downwardly slightly and the numbering head 14 to move toward the impression cylinder 8. Because the pivot points 23 and 25 extending through the arms 24 and 26 are relatively the pivot points 23 and 25 extending through the arms 24 and 26 are relatively close to the ends of the arms received on the blanket cylinder 6, the ends of the pivotal arms 24 and 26 opposite the blanket cylinder 6 are caused to move substantially downwardly in response to even a slight upward movement of the blanket cylinder. Such downward movement of the ends of the pivotal arms causes the tie rods 43 and 45 extending between the pivotal arms and the cam supporting arms 42 and 44 to exert a downward force on the cam supporting arms. The cam supporting arms are thus pivoted around the shaft 36 forcing the cams 48 and 52 downwardly against the spaced circular idler discs 29 and 31 on the numbering head shaft 16. This, in turn, creates a downward force on the numbering head shaft 16 causing the numbering head to move downwardly guided by the aligned slides 37 and 39 into proximate engagement with the impression cylinder 8. The numbering head 14 is not forced downwardly far enough, however, to make printing contact with the paper P received on the impression cylinder.

Figure 7:
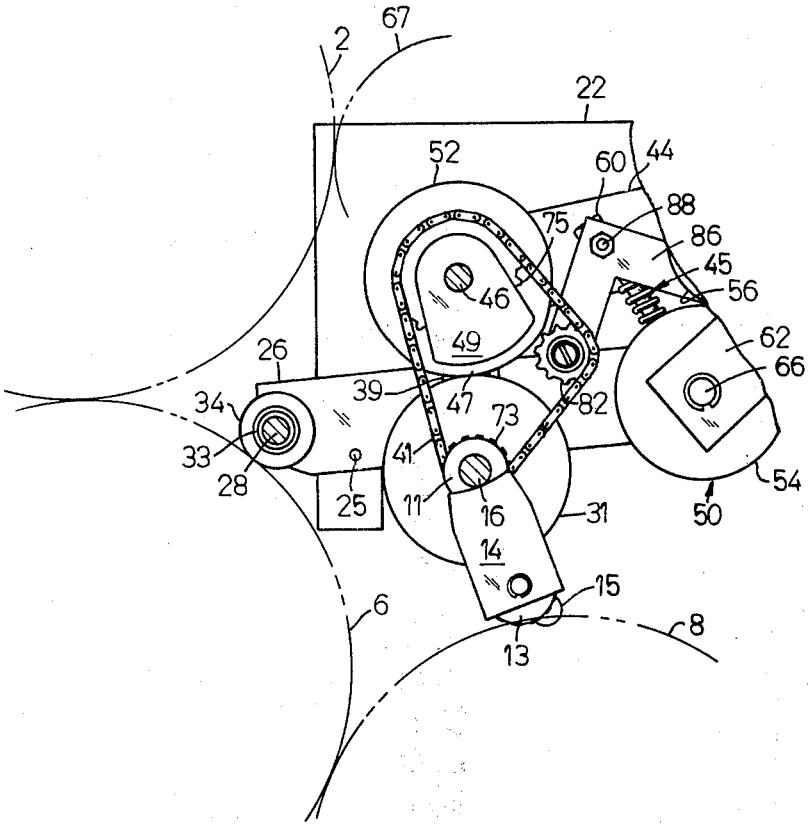
Figure 8:
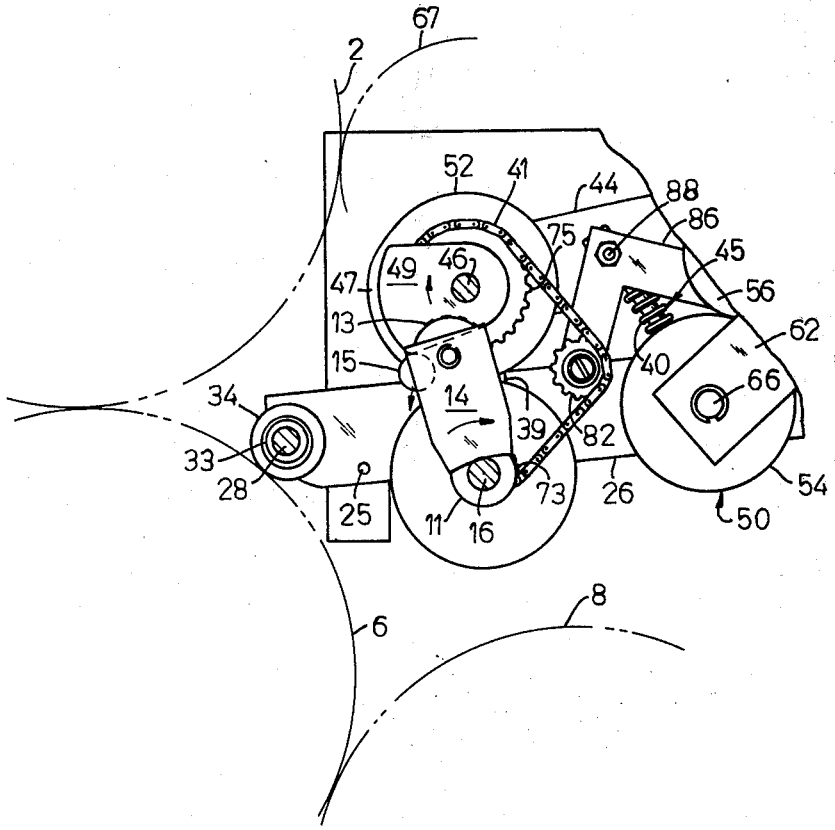

Referring to the sequence of operation shown in FIGS. 5–8, the numbering head 14 and the spaced cams 48 and 52 are shown as being positioned on their respective shafts in such a manner that the lobes 47 of the rotating cams 48 and 51 will contact the spaced circular idler discs 29 and 31 when the numbering head has revolved on shaft 16 to the point where the numbering type 12 are opposite the impression cylinder. The lobes 47 of the cams 48 and 52 force the idler discs 29 and 31 and the numbering head shaft 16 to move downwardly, and consequently force the numbering head 14 downwardly an additional amount into printing engagement with the impression cylinder and paper P received thereon as shown in FIG. 7.

It should also be noted that when the blanket cylinder 6 is actuated to cause the cam shaft 46 to move downwardly relative to the numbering head shaft 16 the indexing cam lobe 49 secured to the cam shaft 46 will be moved close enough to the indexing lever 15 extending from the numbering head that the cam 49 and lever 15 will contact one another (FIG. 8) during their respective rotations. The relative rotation of the indexing cam 49 and the indexing lever will thus result in actuation of the indexing lever 15 such that the numbering head 14 will be indexed one digit.

After the paper P has received an impression printed thereon and a simultaneous printing of a number thereon, a second piece of paper may be fed into the printing press and a consecutive number printed thereon. On the other hand it may be desired to discontinue printing operation wherein the blanket cylinder is disengaged from the plate cylinders and the impression cylinder. Movement of the blanket cylinder downwardly away from the shaft 28 permits pivotal movement of the arms 24 and 26 which are pivotably biased by the springs 20. The springs 61 received in the aligned slides 37 and 39 function to push the shaft 16 upwardly in the aligned slides and the numbering head 14 out of engagement with the impression cylinder 8. The springs 40 on tie rods 43 and 45 also function to bias the cam supporting arms upwardly and the cam shaft away from shaft 16. In this position, the indexing cam 49 and the lever 15 on the numbering head 14 do not come into contact and consequently the shaft 16 and 46 may rotate freely without continuing to index the numbering head.

In order to provide the proper amount of ink to the numbering head, the inking roller 54 may be selectively engaged with the numbering head. If it is desired to increase the supply of ink to the numbering head the shaft 68 may be rotated by the lever 65 such that the inking roller is forced toward the numbering head 14. Each rotation of the numbering head will then permit the numbering head to contact the surface of the inking roller 54 to receive ink therefrom. If, however, too much ink is being supplied to the numbering head, the lever 81 may be activated by the operator to rotate the eccentric shaft 68 to withdraw the inking roller away from the numbering head 14.

RESUME

The present invention thus sets forth a numbering head assembly which can be readily secured to an offset printing press to provide inexpensive relatively uncomplicated means to print consecutive numbers onto material being printed in the printing press. The apparatus of the invention includes means to control indexing of the numbering head to prevent inadvertent indexing of the numbering head when paper is not being received and printed by the press. Furthermore, the numbering head assembly can be attached to the printing press in such a manner that the numbering head prints against the impression cylinder under pressure and in simultaneous relation with the printing step of the printing press. The numbering head assembly also includes means to simply and variably adjust the amount of ink supplied to the numbering head so that a high quality impression may be printed by the numbering head. The numbering head assembly has the particular advantage that it is not unduly burdensome to attach to the printing press in that it need not be inserted into the mechanical structure of the press and can be easily attached to the top of the press. One of the advantages of the apparatus making it easy to mount in the press is that the side plates include threaded bores which are aligned with holes pre-existing in a "Chief 15" offset press so that it is not necessary to bore additional holes in the frame of the printing press to bolt the numbering head assembly in place. The assembly also has the advantage that it does not preclude the operator's view of the printing operation or of the paper received in the printing press, and the invention does not preclude the attachment of other printing attachments to the printing press such as spraying devices, etc.

I claim:

1. An offset printing machine for printing individual sheets simultaneously with a printing impression and also with a consecutive number for each sheet, said machine comprising, an impression cylinder, a blanket cylinder shiftably mounted between a non-printing position away from said impression cylinder and a printing position in which it abuts in rotatable engagement with said impression cylinder, a consecutive numbering head shiftable between a position away from said impression cylinder and a printing position adjacent said impression cylinder, pivotable linkage connecting means interconnecting said blanket cylinder and said numbering head for shifting said numbering head between said positions and for synchronizing movement of said blanket cylinder and numbering head whereby when said blanket cylinder is shifted to said printing position in contact with said impression cylinder, said numbering head is also shifted from said position away from said impression cylinder to said position adjacent said impression cylinder, said pivotable linkage connection means including a pair of pivotable arms, each of said arms including one end resting on said blanket cylinder and an other end supporting said numbering head, and said arms being pivotably secured intermediate said ends, and means for forcing said numbering head into engagement under pressure with said impression cylinder when said blanket cylinder is shifted to said printing position, said forcing means including a camming means and a rotatable shaft rotatably supporting said camming means, said camming means being operably connected to said other ends of said pivotable arms.

2. An offset printing machine for printing individual sheets simultaneously with a printing impression and also with a consecutive number for each sheet, said machine comprising:

a machine frame;

an impression cylinder rotatably supported by said frame;

a blanket cylinder rotatably supported by said frame adjacent to said impression cylinder and shiftably mounted for movement between a non-printing position away from said impression cylinder and a printing position abutting in rotatable engagement with said impression cylinder;

means for shifting said blanket cylinder between said non-printing position and said printing position;

a rotatable shaft;

a consecutive numbering head supported by said rotatable shaft for rotation with said shaft; and means for shifting said shaft and said numbering head toward said impression cylinder when said blanket cylinder is shifted from said non-printing position to said printing position, said means for shifting including a pair of spaced parallel pivotable arms, said arms each having one end engaging said blanket cylinder and an opposite end rotatably supporting said shaft, said shaft being rotatably supported between said pivotable arms, and said arms being pivotably supported by said frame intermediate said ends.

3. A numbering head assembly for attachment to an offset printing press having a rotatable impression cylinder and a blanket cylinder transversely movable toward and away from said impression cylinder, said numbering head assembly comprising:

support means securable to said printing press;

a rotatable numbering head for printing consecutive numbers, said numbering head being shiftable toward and away from said impression cylinder;

means for interconnecting said blanket cylinder and said numbering head and for shifting said numbering head toward said impression cylinder when said blanket cylinder is moved toward said impression cylinder, said means for interconnecting including a pivotable linkage means having opposite ends and being pivotably connected to said support means intermediate said opposite ends, one of said opposite ends being supportable by said blanket cylinder, and a first rotatable shaft rotatably supporting said numbering head and rotatably supported by the other of said opposite ends of said pivotable linkage means; and means for forcing said numbering head into printing engagement with said impression cylinder and against paper supported thereon when said blanket cylinder is moved toward said impression cylinder, said forcing means including rotatable camming means and a second rotatable shaft rotatably supporting said camming means, said camming means being operably engageable with said first rotatable shaft and being operably connected to said other of said opposite ends of said pivotable linkage means, and means for rotating said camming means, whereby when said blanket cylinder is moved toward said impression cylinder, said camming means operably engages said first shaft and said numbering head is forced into printing engagement with said impression cylinder.

4. The numbering head assembly set forth in claim 3 further including means for supporting said second shaft for movement toward said first rotatable shaft in response to movement of said blanket cylinder toward said impression cylinder.

5. The numbering head assembly set forth in claim 3 further including drive means for rotating said numbering head and camming means in timed relation.

6. A numbering head assembly for attachment to an offset printing press having a rotatable impression cylinder and a blanket cylinder transversely movable toward and away from said impression cylinder, said numbering head assembly comprising:

support means securable to said printing press;

a rotatable numbering head for printing consecutive numbers, said numbering head being shiftable toward and away from said impression cylinder;

means for interconnecting said blanket cylinder and said numbering head and for shifting said numbering head toward said impression cylinder when said blanket cylinder is moved toward said impression cylinder, said means for interconnecting including a first pair of pivotable arms each having opposite ends and being pivotably connected to said support means intermediate said opposite ends, one of said opposite ends of each of said pivotable arms being supportable by said blanket cylinder, and a first horizontally extending, vertically movable rotatable shaft rotatably supporting said numbering head and rotatably supported between the other of said opposite ends of said pivotable arms; and means for forcing said numbering head into printing engagement with said impression cylinder and against paper supported thereon when said blanket cylinder is moved toward said impression cylinder, said forcing means including a second horizontally extending, vertically movable rotatable shaft, a second pair of pivotable arms pivotably connected to said support means and operably connected to said first pair of pivotable arms, said second pair of pivotable arms supporting said second shaft therebetween, and rotatable camming means supported by said second vertically movable shaft, said camming means being operably engagable with said first rotatable shaft, and means for rotating said camming means, whereby when said blanket cylinder is moved toward said impression cylinder, said camming means operably engages said first shaft and said numbering head is forced into printing engagement with said impression cylinder.

7. The numbering head assembly set forth in claim 6 further including drive means for rotating said numbering head and camming means in timed relation.

* * * * *